United States Patent [19]

Escott et al.

[11] 4,172,328

[45] Oct. 30, 1979

[54] REACTOR DRYER APPARATUS

[75] Inventors: Robert M. Escott; Winston L. Tennies; Gilbert Y. Whitten, Jr., all of Charlotte, N.C.

[73] Assignee: Midrex Corporation, Charlotte, N.C.

[21] Appl. No.: 883,969

[22] Filed: Mar. 6, 1978

[51] Int. Cl.[2] ..... F26B 7/00; F27D 7/00

[52] U.S. Cl. ..... 34/13; 34/65; 432/99; 432/100

[58] Field of Search ..... 34/13, 64, 65, 66; 432/99, 100, 215

[56] References Cited

U.S. PATENT DOCUMENTS

| | | | |
|---|---|---|---|
| 2,432,503 | 12/1947 | Bergstrom et al. | 432/215 |
| 2,706,343 | 4/1955 | Oholm | 34/13 |
| 4,002,422 | 1/1977 | Escott | 432/99 |

*Primary Examiner*—John J. Camby

*Attorney, Agent, or Firm*—Ralph H. Dougherty

[57] ABSTRACT

Apparatus for contacting a packed bed of particulate material with a treating gas includes a downwardly converging bin, hot gas distributors and a cooling gas distributor. The method whereby the apparatus is used as a reactor dryer to treat particulate sponge iron is also disclosed.

12 Claims, 2 Drawing Figures

REACTOR DRYER APPARATUS

BACKGROUND OF THE INVENTION

This invention relates to an apparatus and method for treating particulate material with a gas. More particularly the invention relates to apparatus for reacting heated air with wet sponge iron and drying the same.

Sponge iron, metallized pellets, briquettes, or reduced metal materials are produced by the direct reduction of ores or metal oxides. Large quantities of metallized iron pellets are made in the direct reduction process wherein particulate iron oxide is reduced substantially to metallic iron by direct contact with a reducing gas such as a mixture of hydrogen and carbon monoxide. Throughout this specification and appended claims, the term "metallized pellets" is intended to include metal-bearing pellets such as sponge iron, briquettes other compacted forms of reduced metal and the like which contain at least 80 percent of their metal in the metallic state with the balance being virtually in the form of metallic oxide. "Metallized" in this sense does not mean coated with metal, but means nearly completely reduced to the metallic state.

A problem associated with the use of sponge iron is its inherent tendency to reoxidize upon exposure to air or water. Exposure of a mass of active sponge iron to atmospheric air and moisture will cause rusting with a significant loss of metallization. Such exposure will also produce heat and can raise the temperature of the mass of sponge iron to such a high temperature that the liberated hydrogen ignites. Hydrogen is liberated from water during the rusting reactions. U.S. Pat. No. 4,069,015 discloses a method of treating sponge iron with a solution of a water soluble alkaline metal silicate which allows the sponge iron product to be stored for long periods of time in the open, even in rainy weather, and to be shipped in open trucks and railroad cars without any significant rusting or loss of metallization. That patent teaches wetting the sponge iron with a dilute aqueous solution of a liquid alkali metal silicate followed by drying the wetted sponge iron, the drying step preferably being carried out under oxidizing conditions and at a temperature substantially below the auto ignition temperature of sponge iron.

OBJECTS OF THE INVENTION

It is the principal object of this invention to provide apparatus for treating particulate material with a gas.

It is another object of this invention to provide apparatus for drying wetted particulate material.

It is also an object of this invention to provide apparatus for drying wetted particulate material with a warm gas, then cooling the material with a cool gas.

It is a further object of this invention to provide apparatus for drying sponge iron, which has been in contact with an aqueous solution of liquid sodium silicate, in an oxidizing atmosphere below the auto ignition temperature of sponge iron.

SUMMARY OF THE INVENTION

The present invention is an apparatus for treating particulate material with a gas, and is particularly suited for drying wetted sponge iron under oxidizing conditions. The apparatus consists of a bin including means for passing warm air across the entire horizontal cross-section of the sponge iron contained therein, along with means for passing cooling gas throughout the dried reacted sponge iron to cool it to handling temperature.

BRIEF DESCRIPTION OF THE DRAWINGS

This invention may be better understood by reference to the following detailed description and the appended drawings in which.

DETAILED DESCRIPTION

Figure 1:
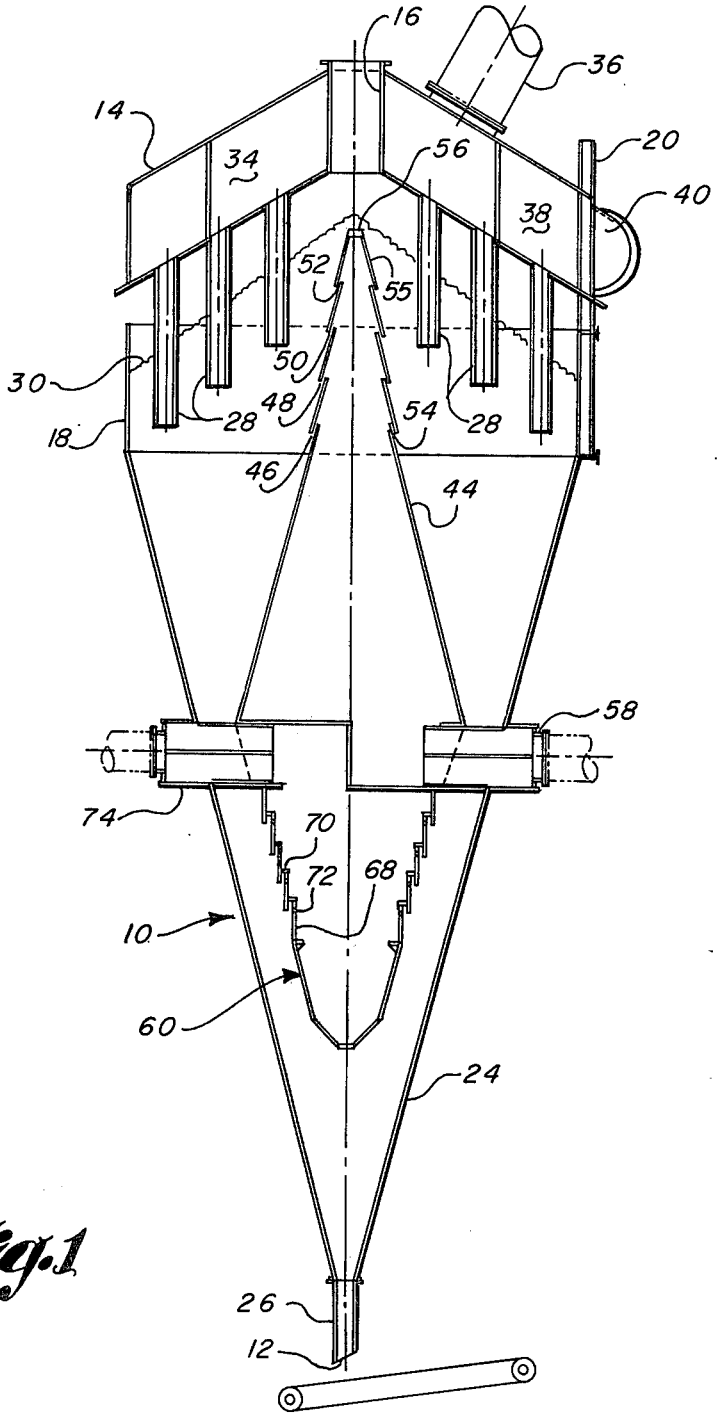
FIG. 1 is a sectional elevational view of the invented apparatus.
Figure 2:
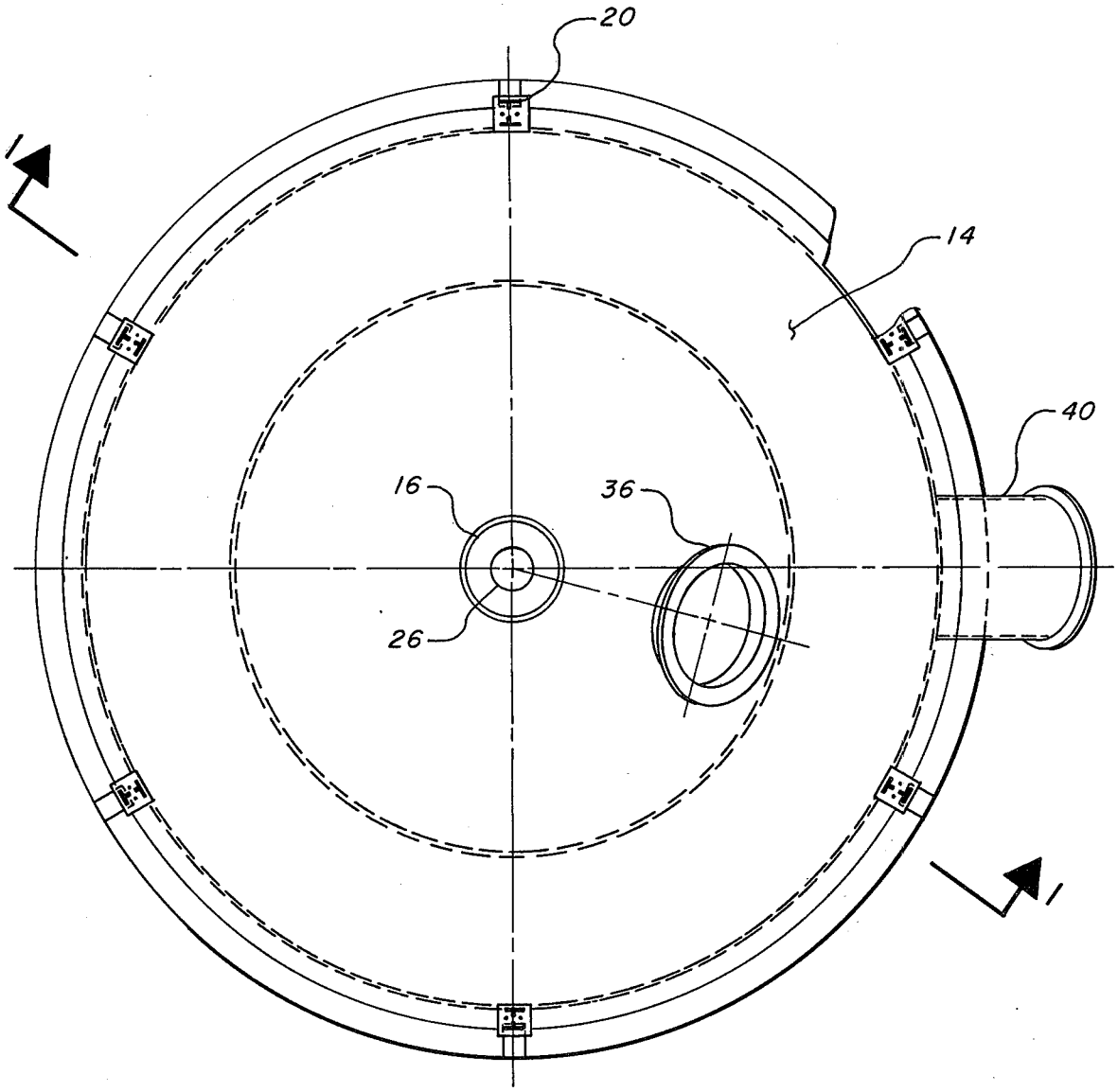
FIG. 2 is a top view of the invented apparatus.

Referring now to the drawings, the apparatus as shown in FIG. 1, consists of a downwardly converging bin 10, having an outlet 12 at the bottom thereof and carrying a hot wind distributor 14 atop the bin which forms a cover to protect the interior of the bin from rain and other precipitation. Central to the hot wind distributor is a material feed pipe or access opening 16. The hot wind distributor is supported and spaced from bin 10 by upright supports 20.

The bin, as shown has a short tubular section 18 and a downwardly converging conical section 24 having at its lower end a material discharge tube 26. Hot wind distributor 14 has depending therefrom a multiplicity of hot wind nozzles 28 which extend downwardly into the burden beneath the stock line 30. The hot wind distributor can be a single chamber distributor or a dual chamber distributor as shown. The central compartment 34 has a hot wind inlet 36. The peripheral compartment 38 has a hot wind inlet 40. The hot wind nozzles 28 are peripherably arranged in an annular fashion with the inner-most ring of nozzles having about half as many nozzles as the outer-most ring.

In the center of the bin 10 is a second hot wind distributor 44 constructed in such manner that the hot wind is directed downwardly from the distributor through annular hot wind discharge slots 46, 48, 50, and 52. A multiplicity of frusto-conical sections are placed atop each other, spaced from and fastened to each other by spacers 54. The upper-most section may be a cone or it may be a frusto-conical section 55 topped by a wear plate 56 of material suited to withstand the impact and erosive action of the incoming pellets. Hot wind is provided to the interior of distributor 44 through hot wind inlet 58.

A pellet cooler 60 is positioned in the lower portion of bin 10. This cooler consists of a plurality of tiered gas discharge units nested one within the other and arranged in progressively smaller sizes from the top of the distributor. Each gas unit comprises a peripherally extending open ended side wal 68 having an outwardly extending support flange 70. Each support flange of each gas unit is positioned within and secured to the side wall of the gas unit immediately thereabove. Gas outlets 72 may be spaced adjacent the top end of each gas outlet side wall or alternatively may be placed in each support flange or both. Cooling gas enters the distributor 60 through cooling gas inlet 74.

Thermocouples are provided in numerous places in the apparatus to permit the operator to have maximum control.

In operation, wetted pellets are accumulated then fed through pellet inlet 16 to the interior of bin 10 forming a burden therein having a stockline 30. Pellets move down the surface of the internal gas distributor 44 with the finer materials remaining nearer the distributor and the larger pieces rolling to the outer wall of the bin.

Heated air at about 120° C. (about 250° F.) is introduced through nozzles 28 from distributor 14 and through openings 46, 48, 50, and 52 in distributor 44 into the burden. The pellets are thus dried in oxidizing atmosphere since the hot wind is mostly air with some products of combustion. As pellets are drawn off through discharge tube 26 the burden moves downwardly and is cooled by ambient air from cooling gas distributor 60. The hot wind is vented to the atmosphere through openings between the bin wall 18 and the hot wind distributor 14. The cooling air moves upwardly along the wall of the bin 10 gradually being warmed by the pellets and is vented through the same openings as the hot wind.

ALTERNATIVE EMBODIMENTS

The cover 14 need not form an integral part of the hot air distribution system but may be merely a cover over the apparatus to protect the particulate material therein from the effects of rain, snow, sleet, etc. The hot air distribution system may consist of a plurality of pneumatic headers, each feeding one or more hot wind nozzles 28.

In certain situations, the central hot wind distributor 44 situated in the center of the burden may be eliminated all together.

If it is desired to discharge hot particulates, the cooling gas system may be omitted from the apparatus.

The cross-section of bin 10 may have any of several geometric shapes such as round, oval, square, rectangular, etc.

SUMMARY OF THE ACHIEVEMENT OF THE OBJECTS OF THE INVENTION

From the foregoing it is clear that this invention provides an apparatus for treating particulate material with a gas, the apparatus being particularly well suited for drying wetted particulate material in the form of pellets, lumps, or fines. The apparatus can be used for drying particulate material such as sponge iron with a warm gas, then cooling the material to handling temperature with a cool gas. The apparatus is especially suited for drying sponge iron in an oxidizing atmosphere at a temperature beneath the auto ignition temperature of sponge iron.

It is readily apparent that other changes and modifications can be made without departing from the spirit of the invention. Thus, it is to be particularly understood that the invention is not limited to the preferred and alternative embodments described above but only to the appended claims.

What is claimed is:

1. Apparatus for treating particulate material with a gas, comprising:

(a) an elongated receptacle being at least partly of a configuration converging toward its lower end, (b) means for introducing particulate material into the upper portion of said receptacle to form a burden therein having a stockline at its upper surface, (c) means for discharging treated particles from its lower end, (d) a plurality of substantially vertical nozzles extending downwardly through said stockline for introducing heated treating gas into said burden in the upper portion of said receptacle beneath the stockline, and (e) means for venting exhausted gas from said receptacle above said stockline.

2. Apparatus according to claim 1 further comprising a central hot wind distributor within said burden, said distributor comprising a plurality of frusto-conical sections, the base of each of said sections being spaced from the adjacent section beneath it whereby heated gas can escape from the interior of said section into the particulate burden.

3. Apparatus according to claim 2 further comprising a wear plate atop the uppermost section.

4. Apparatus according to claim 1 further comprising a cover over its upper end.

5. Apparatus according to claim 4 wherein said cover is provided with a generally central opening therein for introducing particulate material to the interior of said receptacle.

6. Apparatus according to claim 4 wherein said cover includes a hot wind distribution chamber from which a multiplicity of hot wind nozzles extends downwardly therefrom into said receptacle beneath the burden stockline.

7. Apparatus according to claim 6 wherein said cover includes a plurality of hot wind distribution chambers each of which carries a multiplicity of hot wind nozzles extending downwardly therefrom into said receptacle beneath the burden stockline.

8. Apparatus according to claim 4 wherein said cover is spaced from and supported by said receptacle, whereby said stockline is exposed to the atmosphere.

9. Apparatus according to claim 1 wherein said receptacle is at least partly of a conical configuration.

10. Apparatus according to claim 1 further comprising means for introducing a cooling gas to the lower portion of said receptacle.

11. Apparatus according to claim 10 wherein said means for introducing a cooling gas comprises a plurality of tiered gas discharge units nested one within the other and arranged in progressively smaller sizes from top to bottom.

12. A method for treating particulate material comprising:

(a) charging said particulate material into a bin to establish a burden therein, the exposed upper surface of said burden forming a stockline;

(b) removing treated material from the bottom of said bin to establish a gravitational flow of said burden;

(c) introducing heated treating gas to the burden beneath the stockline thereof at a plurality of points throughout the cross-section of the burden;

(d) introducing a cooling gas to said heated burden at an elevation beneath the lowest elevation at which heated gas is introduced to said burden;

(e) removing both cooling gas and spent treating gas from the burden at the stockline, and (f) exhausting both spent treating gas and cooling gas to the atmosphere.

* * * * *